US012134875B2

(12) United States Patent
Akita et al.

(10) Patent No.: US 12,134,875 B2
(45) Date of Patent: Nov. 5, 2024

(54) WORK MACHINE

(71) Applicant: HITACHI CONSTRUCTION MACHINERY CO., LTD., Tokyo (JP)

(72) Inventors: Tarou Akita, Tsuchiura (JP); Takahiro Kobayashi, Tsuchiura (JP); Akihiro Narazaki, Tsukuba (JP); Masamichi Ito, Toride (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 673 days.

(21) Appl. No.: 17/436,486

(22) PCT Filed: Sep. 29, 2020

(86) PCT No.: PCT/JP2020/037016
§ 371 (c)(1),
(2) Date: Sep. 3, 2021

(87) PCT Pub. No.: WO2021/065952
PCT Pub. Date: Apr. 8, 2021

(65) Prior Publication Data

US 2022/0186458 A1 Jun. 16, 2022

(30) Foreign Application Priority Data

Sep. 30, 2019 (JP) ..... 2019-180039

(51) Int. Cl.
*E02F 3/42* (2006.01)
*E02F 3/43* (2006.01)
*E02F 9/22* (2006.01)

(52) U.S. Cl.
CPC ..... *E02F 3/425* (2013.01); *E02F 3/435* (2013.01); *E02F 9/2292* (2013.01)

(58) Field of Classification Search
CPC ..... E02F 3/425; E02F 3/435; E02F 9/2292; E02F 9/2228; E02F 9/2282; E02F 9/2296;
(Continued)

(56) References Cited

U.S. PATENT DOCUMENTS

2016/0069044 A1 3/2016 Takaura et al.
2016/0251835 A1 9/2016 Kitajima et al.

FOREIGN PATENT DOCUMENTS

EP 3608548 A1 2/2020
JP 2019019567 A * 2/2019
(Continued)

OTHER PUBLICATIONS

English Translation for WO-2020044711-A1 using Google Patents/PE2E Search , 2020 (Year: 2020).*
(Continued)

*Primary Examiner* — Thomas E Worden
*Assistant Examiner* — Matthew John Moscola
(74) *Attorney, Agent, or Firm* — MATTINGLY & MALUR, PC

(57) ABSTRACT

When an operation amount of an operation lever corresponding to a boom cylinder is equal to or smaller than an operation amount of an operation lever corresponding to an arm cylinder, an estimated velocity of the arm cylinder used for region limiting control is computed on the basis of a first condition defining, in advance, a relation between the operation amount of the operation lever and the estimated velocity of the arm cylinder. When the operation amount of the operation lever corresponding to the boom cylinder is larger than the operation amount of the operation lever corresponding to the arm cylinder, the estimated velocity of the arm cylinder used for the region limiting control is computed as a velocity higher than the estimated velocity of the arm
(Continued)

cylinder computed on the basis of the first condition. The behavior of the work device can thereby be stabilized.

2 Claims, 13 Drawing Sheets

(58) Field of Classification Search
CPC ..... E02F 9/2203; E02F 9/2033; E02F 9/2285; E02F 3/42; E02F 9/22; E02F 9/2207; E02F 9/2221; E02F 9/2264; E02F 9/2267; E02F 9/221
See application file for complete search history.

(56) References Cited

FOREIGN PATENT DOCUMENTS

| | | | | | |
|---|---|---|---|---|---|
| KR | 20150133818 | A | * | 11/2015 | |
| KR | 102088785 | B1 | * | 7/2017 | |
| WO | 2015/025985 | A1 | | 2/2015 | |
| WO | 2015/186180 | A1 | | 12/2015 | |
| WO | 2019/123511 | A1 | | 6/2019 | |
| WO | 2019/180798 | A1 | | 9/2019 | |
| WO | WO-2020044711 | A1 | * | 3/2020 | ..... E02F 3/32 |

OTHER PUBLICATIONS

English Translation for KR 20150133818 A using Google Patents/PE2E SEARCH, 2015 (Year: 2015).*
English Translation for JP-2019019567-A using Google Patents/PE2E SEARCH, 2019 (Year: 2019).*
English Translation for KR 102088785 B1 using Google Patents/PE2E Search, 2017 (Year: 2017).*
International Search Report of PCT/JP2020/037016 dated Dec. 8, 2020.
International Preliminary Report on Patentability received in corresponding International Application No. PCT/JP2020/037016 dated Apr. 14, 2022.

* cited by examiner

WORK MACHINE

TECHNICAL FIELD

The present invention relates to a work machine.

BACKGROUND ART

There is machine control (MC) as a technology for improving work efficiency of a work machine (for example, a hydraulic excavator) including a work device driven by hydraulic actuators (for example, a work device including a boom, an arm, and a bucket). The machine control (hereinafter referred to simply as the MC) is a technology that assists in operation of an operator by semiautomatically controlling operation of the work device according to operation of an operation device by the operator and a condition determined in advance.

As a technology related to such MC, Patent Document 1, for example, discloses a work vehicle including a boom, an arm, a bucket, an arm cylinder that drives the arm, a directional control valve that has a movable spool and operates the arm cylinder by supplying hydraulic operating fluid to the arm cylinder by movement of the spool, a computing section configured to compute an estimated velocity of the arm cylinder on the basis of correlation between an amount of movement of the spool of the directional control valve according to an operation amount of an arm operation lever and a velocity of the arm cylinder, and a velocity determining section configured to determine a target velocity of the boom on the basis of the estimated velocity of the arm cylinder. When the operation amount of the arm operation lever is less than a predetermined amount, the computing section computes, as the estimated velocity of the arm cylinder, a velocity higher than the velocity of the arm cylinder according to the correlation between the amount of movement of the spool of the directional control valve according to the operation amount of the arm operation lever and the velocity of the arm cylinder.

PRIOR ART DOCUMENT

Patent Document

Patent Document 1: International Publication No. WO 2015/025985

SUMMARY OF THE INVENTION

Problem to be Solved by the Invention

In the above-described conventional technology, the velocity of the arm cylinder is intended to be estimated more accurately by considering the own weight of the work device which weight affects the velocity of the arm cylinder. However, when the above-described conventional technology is applied to a work machine using a positive flow control system and open-centered control valves, for example, a pump flow rate is controlled while priority is given to an actuator corresponding to a larger operation amount at a time of combined operation. Thus, a pump flow rate supplied to an actuator corresponding to a smaller operation amount may be increased, and thus an actual velocity may be faster than the estimated velocity computed from metering characteristics at a time of single operation. That is, there is a fear that the actual velocity of the actuator becomes different from a measured velocity at a time of combined operation, hunting or the like occurs in operation of the work device, and thus behavior thereof becomes unstable.

The present invention has been made in view of the above. It is an object of the present invention to provide a work machine that can stabilize the behavior of a work device.

Means for Solving the Problem

The present application includes a plurality of means for solving the above-described problem. To cite an example of the means, there is provided a work machine including: an articulated work device formed by a plurality of driven members including a boom having a proximal end rotatably coupled to an upper swing structure, an arm having one end rotatably coupled to a distal end of the boom, and a work tool rotatably coupled to another end of the arm; a plurality of hydraulic actuators including a boom cylinder that drives the boom on the basis of an operation signal, an arm cylinder that drives the arm on the basis of an operation signal, and a work tool cylinder that drives the work tool on the basis of an operation signal; a plurality of hydraulic pumps that deliver hydraulic fluid for driving the plurality of hydraulic actuators; operation devices that output an operation signal for operating a hydraulic actuator desired by an operator among the plurality of hydraulic actuators; a plurality of flow control valves that are arranged so as to respectively correspond to the plurality of hydraulic actuators, and that control directions and flow rates of the hydraulic fluid supplied from the hydraulic pumps to the plurality of hydraulic actuators on the basis of the operation signals from the operation devices; and a controller configured to output a control signal that controls the flow control valve corresponding to at least one of the plurality of hydraulic actuators such that the work device operates within a region on and above a target surface set for a work target of the work device, or perform region limiting control that corrects the control signal output to control the flow control valve corresponding to at least one of the plurality of hydraulic actuators from the operation devices. The controller is configured to compute an estimated velocity of the arm cylinder used for the region limiting control on the basis of a first condition defining, in advance, a relation between an operation amount of the operation device corresponding to the arm cylinder and the estimated velocity of the arm cylinder when an operation amount of the operation device corresponding to the boom cylinder is equal to or smaller than the operation amount of the operation device corresponding to the arm cylinder, and the controller is configured to compute the estimated velocity of the arm cylinder used for the region limiting control as a velocity higher than the estimated velocity of the arm cylinder computed on the basis of the first condition when the operation amount of the operation device corresponding to the boom cylinder is larger than the operation amount of the operation device corresponding to the arm cylinder.

Advantages of the Invention

According to the present invention, the behavior of the work device can be stabilized.

MODES FOR CARRYING OUT THE INVENTION

Figure 1:
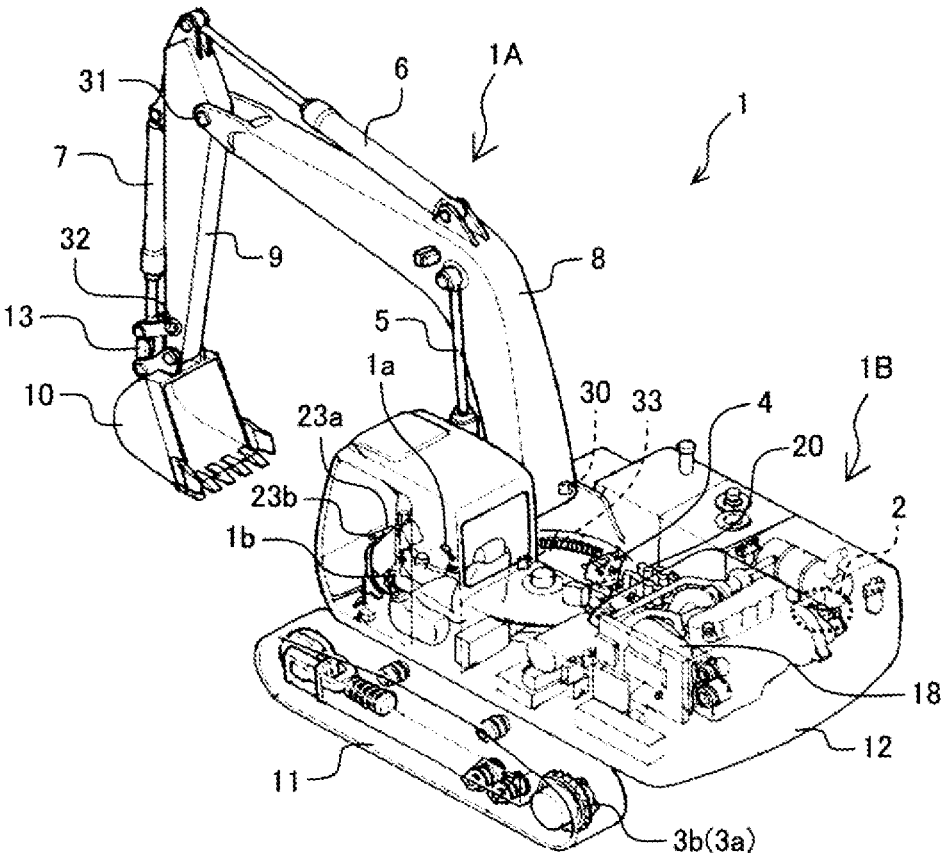
FIG. 1 is a diagram schematically illustrating an external appearance of a hydraulic excavator as an example of a work machine.

An embodiment of the present invention will hereinafter be described with reference to the drawings. It is to be noted that, while a hydraulic excavator having a bucket as a work tool (attachment) at a distal end of a work device will be illustrated and described as an example of a work machine in the following description, the present invention can be applied to work machines having an attachment other than a bucket. In addition, application to work machines other than the hydraulic excavator is also possible as long as the work machines have an articulated work device formed by coupling a plurality of driven members (an attachment, an arm, a boom, and the like).

In addition, in the following description, with regard to the meaning of a word "on," "above," or "below" used together with a term representing a certain shape (for example, a target surface, a design surface, or the like), suppose that "on" means a "surface" of the certain shape, that "above" means a "position higher than the surface" of the certain shape, and that "below" means a "position lower than the surface" of the certain shape.

In addition, in the following description, when there are a plurality of identical constituent elements, alphabetic letters may be attached to ends of reference characters (numerals) thereof. However, the plurality of constituent elements may be represented collectively with the alphabetic letters omitted. Specifically, when there are two hydraulic pumps 2*a* and 2*b*, for example, these hydraulic pumps may be represented collectively as hydraulic pumps 2.

<Basic Configuration>

Figure 2:
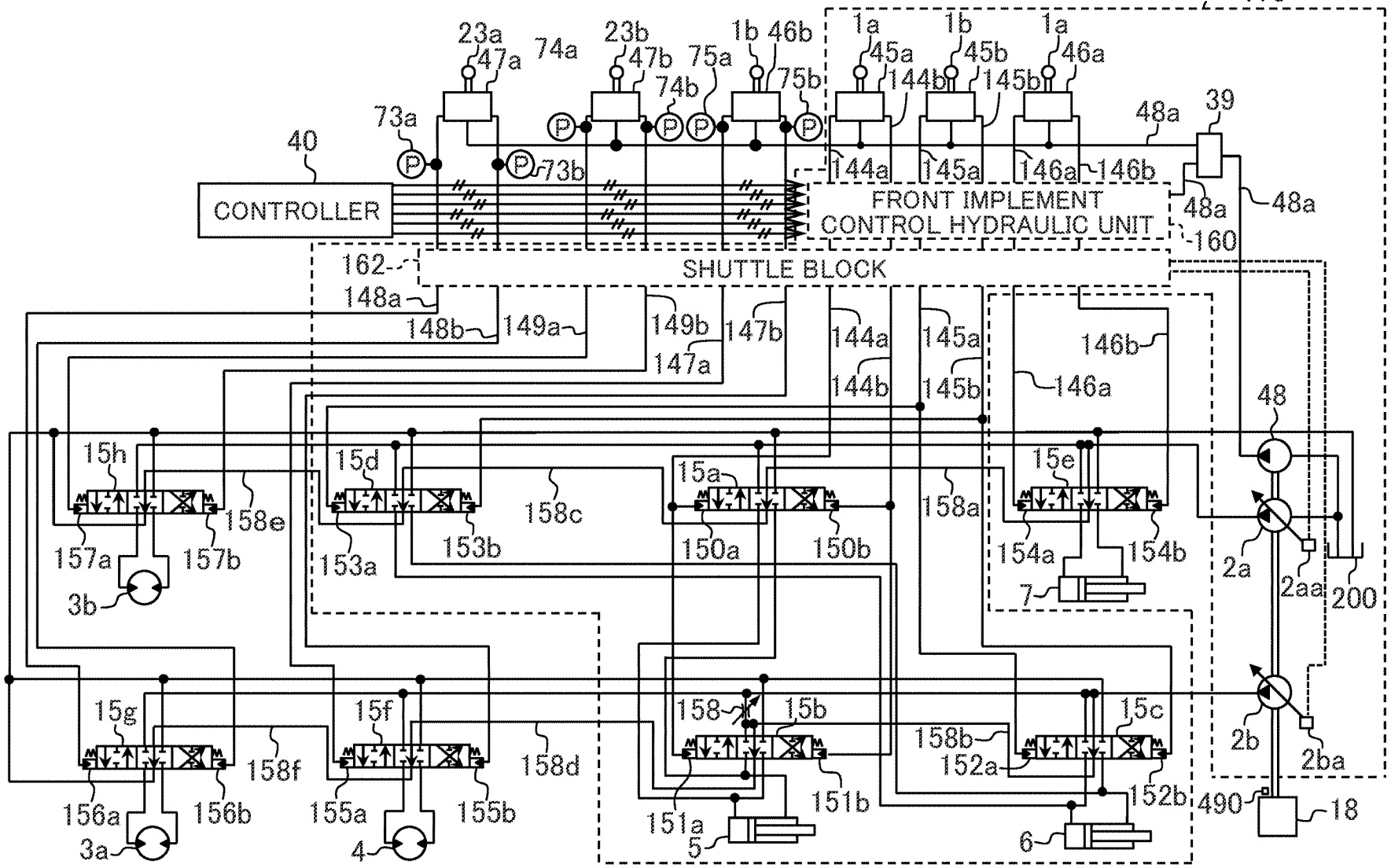
FIG. 2 is a diagram illustrating a hydraulic circuit system of the hydraulic excavator by extracting the hydraulic circuit system together with a peripheral configuration including a controller.
Figure 3:
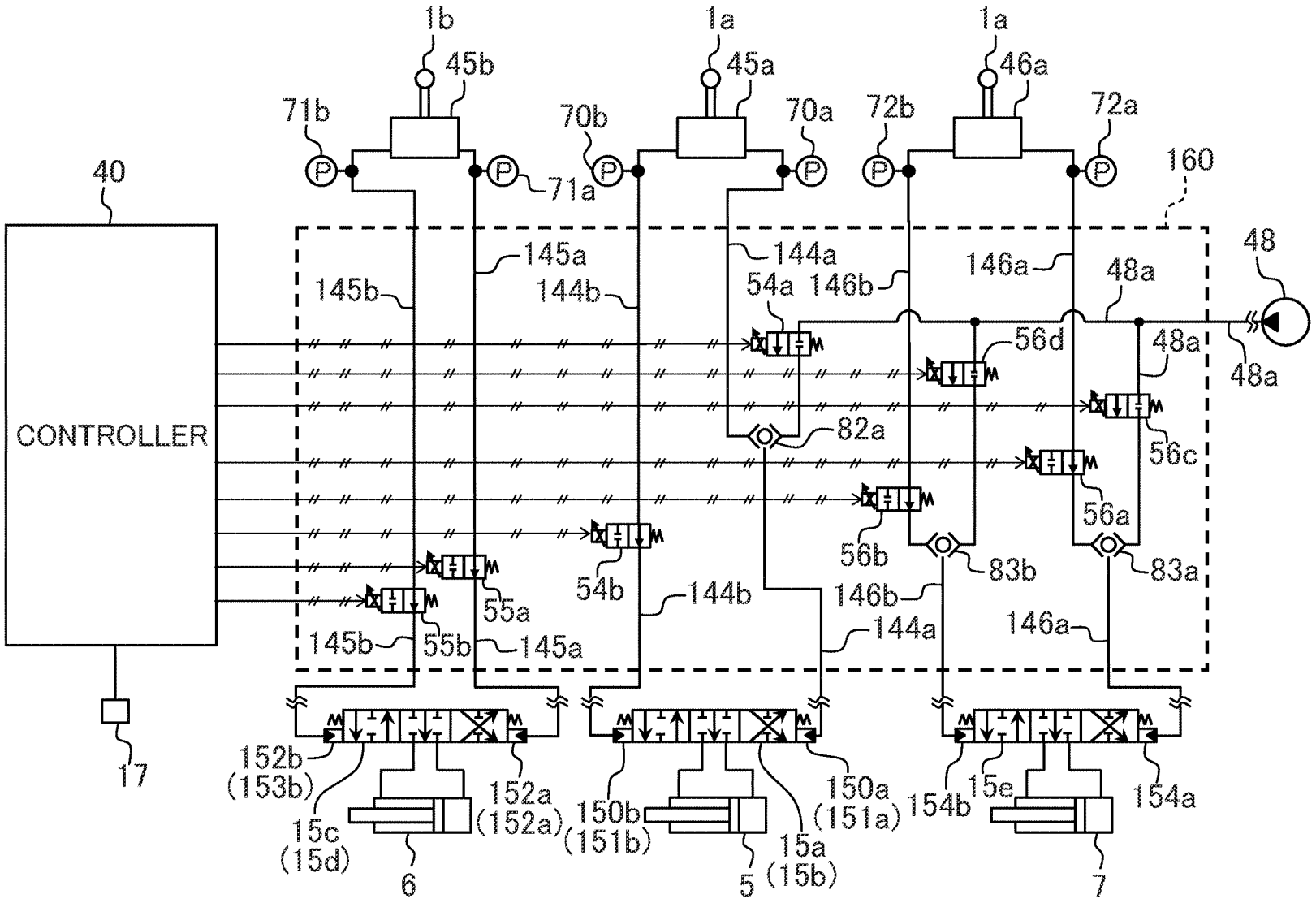
FIG. 3 is a diagram illustrating a front implement control hydraulic unit in FIG. 2 in detail by extracting the front implement control hydraulic unit together with a related configuration.

FIG. 1 is a diagram schematically illustrating an external appearance of a hydraulic excavator as an example of a work machine according to the present embodiment. In addition, FIG. 2 is a diagram illustrating a hydraulic circuit system of the hydraulic excavator by extracting the hydraulic circuit system together with a peripheral configuration including a controller. FIG. 3 is a diagram illustrating a front implement control hydraulic unit in FIG. 2 in detail by extracting the front implement control hydraulic unit together with a related configuration.

In FIG. 1, the hydraulic excavator 1 is formed by an articulated work device 1A and a main body 1B. The main body 1B of the hydraulic excavator 1 includes a undercarriage 11 that travels by left and right travelling hydraulic motors 3*a* and 3*b* and an upper swing structure 12 that is attached onto the undercarriage 11 and swung by a swing hydraulic motor 4.

The work device 1A is formed by coupling a plurality of driven members (a boom 8, an arm 9, and a bucket 10) that each rotate in a vertical direction. A proximal end of the boom 8 is rotatably supported on a front portion of the upper swing structure 12 via a boom pin. The arm 9 is rotatably coupled to a distal end of the boom 8 via an arm pin. The bucket 10 is rotatably coupled to a distal end of the arm 9 via a bucket pin. The boom 8 is driven by a boom cylinder 5. The arm 9 is driven by an arm cylinder 6. The bucket 10 is driven by a bucket cylinder 7. Incidentally, in the following description, the boom cylinder 5, the arm cylinder 6, and the bucket cylinder 7 may be referred to collectively as hydraulic cylinders 5, 6, and 7 or hydraulic actuators 5, 6, and 7.

Figure 8:
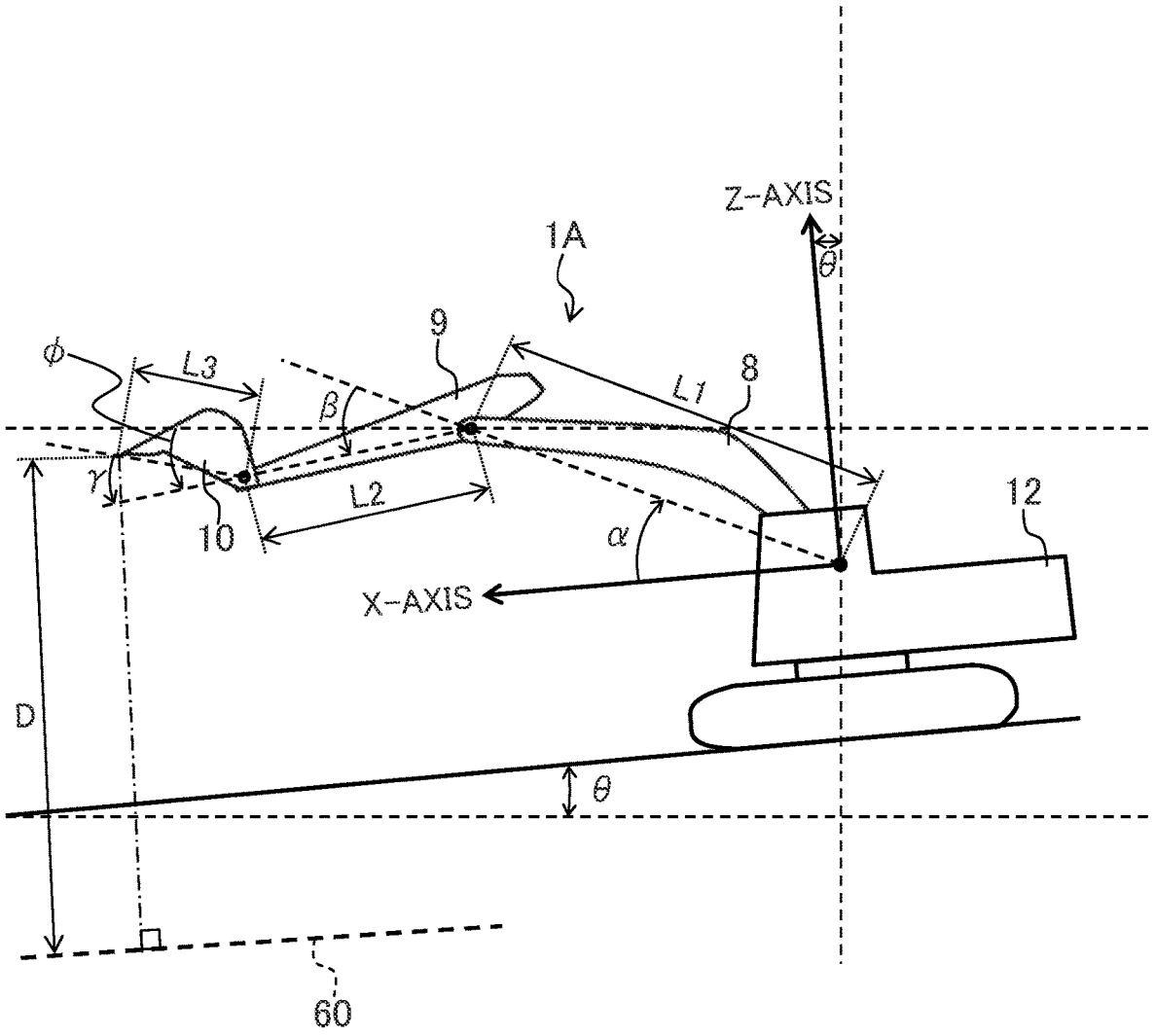
FIG. 8 is a diagram of assistance in explaining an excavator coordinate system set for the hydraulic excavator.

FIG. 8 is a diagram of assistance in explaining an excavator coordinate system set for the hydraulic excavator.

As illustrated in FIG. 8, in the present embodiment, an excavator coordinate system (local coordinate system) is defined for the hydraulic excavator 1. The excavator coordinate system is an XY coordinate system defined in a fixed manner relative to the upper swing structure 12. As the excavator coordinate system, a machine body coordinate system is set which has the proximal end of the boom 8 rotatably supported by the upper swing structure 12 as an origin, has a Z-axis passing through the origin in a direction along a swing axis of the upper swing structure 12 and having an upward direction as a positive direction thereof, and has an X-axis that is a direction along a plane in which the work device 1A is operated and which passes through the proximal end of the boom perpendicularly to the Z-axis and has a forward direction as a positive direction thereof.

In addition, a length of the boom 8 (linear distance between coupling portions at both ends) will be defined as L1. A length of the arm 9 (linear distance between coupling portions at both ends) will be defined as L2. A length of the bucket 10 (linear distance between a coupling portion coupled to the arm and a claw tip) will be defined as L3. An angle formed between the boom 8 and the X-axis (relative angle between a straight line in a length direction and the X-axis) will be defined as a rotational angle $\alpha$. An angle formed between the arm 9 and the boom 8 (relative angle between straight lines in length directions) will be defined as a rotational angle $\beta$. An angle formed between the bucket 10 and the arm 9 (relative angle between straight lines in length directions) will be defined as a rotational angle $\gamma$. Coordinates of a position of the bucket claw tip and a posture of the work device 1A in the excavator coordinate system can thereby be expressed by L1, L2, L3, $\alpha$, $\beta$, and $\gamma$.

Further, an inclination in a forward-rearward direction of the main body 1B of the hydraulic excavator 1 with respect to a horizontal plane will be set as an angle $\theta$. A distance between the claw tip of the bucket 10 of the work device 1A and a target surface 60 will be set as D. Incidentally, the target surface 60 is a target excavation surface set as a target of excavation work on the basis of design information for a construction site or the like.

As posture sensors for measuring the rotational angles α, β, and γ of the boom 8, the arm 9, and the bucket 10 of the work device 1A, a boom angle sensor 30 is attached to the boom pin, an arm angle sensor 31 is attached to the arm pin, and a bucket angle sensor 32 is attached to a bucket link 13. In addition, a machine body inclination angle sensor 33 that detects the inclination angle θ of the upper swing structure 12 (the main body 1B of the hydraulic excavator 1) with respect to a reference surface (for example, the horizontal plane) is attached to the upper swing structure 12. Incidentally, while the angle sensors 30, 31, and 32 will be illustrated and described as angle sensors that detect relative angles at the respective coupling portions of the plurality of driven members 8, 9, and 10, the angle sensors 30, 31, and 32 can be replaced with inertial measurement units (IMUs) that detect respective relative angles of the plurality of driven members 8, 9, and 10 with respect to the reference surface (for example, the horizontal plane).

In addition, in FIG. 1 and FIG. 2, installed within a cab provided to the upper swing structure 12 are: an operation device 47*a* (FIG. 2) for operating the right travelling hydraulic motor 3*a* (that is, the undercarriage 11), the operation device 47*a* having a right travelling operation lever 23*a* (FIG. 1); an operation device 47*b* (FIG. 2) for operating the left travelling hydraulic motor 3*b* (that is, the undercarriage 11), the operation device 47*b* having a left travelling operation lever 23*b* (FIG. 1); operation devices 45*a* and 46*a* (FIG. 2) for operating the boom cylinder 5 (that is, the boom 8) and the bucket cylinder 7 (that is, the bucket 10), the operation devices 45*a* and 46*a* sharing a right operation lever 1*a* (FIG. 1); and operation devices 45*b* and 46*b* (FIG. 2) for operating the arm cylinder 6 (that is, the arm 9) and the swing hydraulic motor 4 (that is, the upper swing structure 12), the operation devices 45*b* and 46*b* sharing a left operation lever 1*b* (FIG. 1). Incidentally, in the following, the right travelling operation lever 23*a* and the left travelling operation lever 23*b* may be referred to collectively as travelling operation levers 23*a* and 23*b*, and the right operation lever 1*a* and the left operation lever 1*b* may be referred to collectively as operation levers 1*a* and 1*b*.

Also arranged within the cab are: a display device (for example, a liquid crystal display) 53 that can display a positional relation between the target surface 60 and the work device 1A; an MC control ON/OFF switch 98 for selectively selecting enabling and disabling (ON/OFF) of operation control by machine control (hereinafter referred to as MC); a control selection switch 97 for selectively selecting enabling and disabling (ON/OFF) of bucket angle control (referred to also as work tool angle control) by the MC; a target angle setting device 96 for setting an angle (target angle) of the bucket 10 with respect to the target surface 60 in the bucket angle control by the MC; and a target surface setting device 51 as an interface that allows input of information regarding the target surface 60 (including positional information and inclination angle information of each target surface) (see FIG. 4 and FIG. 5 in the following).

The control selection switch 97 is, for example, provided to an upper end portion of a front surface of the operation lever 1*a* of a joystick shape, and depressed by a thumb of an operator gripping the operation lever 1*a*. In addition, the control selection switch 97 is, for example, a momentary switch, and is thus switched between the enabling (ON) and the disabling (OFF) of the bucket angle control (work tool angle control) each time the control selection switch 97 is depressed. Incidentally, the installation position of the control selection switch 97 is not limited to the operation lever 1*a* (1*b*), but may be disposed at another position. In addition, the control selection switch 97 does not need to be constituted by hardware. For example, the display device 53 may be formed as a touch panel, and the control selection switch 97 may be constituted by a graphical user interface (GUI) displayed on a display screen of the touch panel.

The target surface setting device 51 is connected to an external terminal (not illustrated) that stores three-dimensional data of the target surface defined on a global coordinate system (absolute coordinate system). The target surface setting device 51 sets the target surface 60 on the basis of information from the external terminal. Incidentally, the input of the target surface 60 via the target surface setting device 51 may be performed manually by the operator.

As illustrated in FIG. 2, an engine 18 as a prime mover mounted in the upper swing structure 12 drives hydraulic pumps 2*a* and 2*b* and a pilot pump 48. The hydraulic pumps 2*a* and 2*b* are variable displacement pumps whose displacements are controlled by regulators 2*aa* and 2*ba*. The pilot pump 48 is a fixed displacement pump. The hydraulic pumps 2 and the pilot pump 48 suck hydraulic operating fluid from a hydraulic operating fluid tank 200.

A shuttle block 162 is provided in the middle of pilot lines 144, 145, 146, 147, 148, and 149 that transmit hydraulic signals output as operation signals from the operation devices 45, 46, and 47. The hydraulic signals output from the operation devices 45, 46, and 47 are also input to the regulators 2*aa* and 2*ba* via the shuttle block 162. The shuttle block 162 is constituted by a plurality of shuttle valves or the like for selectively extracting the hydraulic signals of the pilot lines 144, 145, 146, 147, 148, and 149. However, a description of a detailed configuration of the shuttle block 162 will be omitted. The hydraulic signals from the operation devices 45, 46, and 47 are input to the regulators 2*aa* and 2*ba* via the shuttle block 162, and delivery flow rates of the hydraulic pumps 2*a* and 2*b* are controlled according to the hydraulic signals.

A pump line 48*a* as a delivery pipe of the pilot pump 48 passes through a lock valve 39, and thereafter branches into a plurality of lines, which are connected to the operation devices 45, 46, and 47 and each valve within a front implement control hydraulic unit 160. The lock valve 39 is, for example, a solenoid selector valve. An electromagnetic driving section of the solenoid selector valve is electrically connected to a position sensor of a gate lock lever not illustrated that is disposed in the cab (FIG. 1). A position of the gate lock lever is detected by the position sensor. A signal corresponding to the position of the gate lock lever is input from the position sensor to the lock valve 39. When the position of the gate lock lever is a lock position, the lock valve 39 is closed to interrupt the pump line 48*a*. When the position of the gate lock lever is a lock release position, the lock valve 39 is opened to open the pump line 48*a*. That is, in a state in which the gate lock lever is operated to the lock position and thus the pump line 48*a* is interrupted, operation using the operation devices 45, 46, and 47 is disabled, and operation such as swing and excavation is inhibited.

The operation devices 45, 46, and 47 are of a hydraulic pilot type. The operation devices 45, 46, and 47 generate, as hydraulic signals, pilot pressures (which may be referred to as operation pressures) corresponding to operation amounts (for example, lever strokes) and operation directions of the operation levers 1*a*, 1*b*, 23*a*, and 23*b* operated by the operator on the basis of hydraulic fluid delivered from the pilot pump 48. The thus generated pilot pressures (hydraulic signals) are supplied to hydraulic driving sections 150*a* to 157*b* of corresponding flow control valves 15*a* to 15*h* (see FIG. 2 and FIG. 3) via pilot lines 144*a* to 149*b* (see FIG. 3), and are used as operation signals for driving these flow control valves 15*a* to 15*h*.

Hydraulic fluids delivered from the hydraulic pumps 2 are supplied to the right travelling hydraulic motor 3*a*, the left travelling hydraulic motor 3*b*, the swing hydraulic motor 4, the boom cylinder 5, the arm cylinder 6, and the bucket cylinder 7 via the flow control valves 15*a* to 15*h* (see FIG. 2), and are introduced into the hydraulic operating fluid tank 200 via center bypass lines 158*a* to 158*d* connecting the flow control valves 15*a* to 15*h* to one another. The hydraulic fluids supplied from the hydraulic pumps 2 via the flow control valves 15*a* and 15*b* expand or retract the boom cylinder 5, the hydraulic fluids supplied via the flow control valves 15*c* and 15*d* expand or retract the arm cylinder 6, and the hydraulic fluid supplied via the flow control valve 15*e* expands or retracts the bucket cylinder 7. Consequently, the boom 8, the arm 9, and the bucket 10 are each rotated, so that the position and posture of the bucket 10 are changed. In addition, the hydraulic fluid supplied from the hydraulic pumps 2 via the flow control valve 15*f* rotates the swing hydraulic motor 4. The upper swing structure 12 thereby swings with respect to the undercarriage 11. In addition, the hydraulic fluids supplied from the hydraulic pumps 2 via the flow control valves 15*g* and 15*h* rotate the right travelling hydraulic motor 3*a* and the left travelling hydraulic motor 3*b*. The undercarriage 11 thereby travels.

<Front Implement Control Hydraulic Unit 160>

As illustrated in FIG. 3, the front implement control hydraulic unit 160 includes: pressure sensors 70*a* and 70*b* as operator operation sensors that are provided to the pilot lines 144*a* and 144*b* of the operation device 45*a* for the boom 8, and detect a pilot pressure (first control signal) as an operation amount of the operation lever 1*a*; a solenoid proportional valve 54*a* that has a primary port side connected to the pilot pump 48 via the pump line 48*a*, and reduces and outputs a pilot pressure from the pilot pump 48; a shuttle valve 82*a* that is connected to the pilot line 144*a* of the operation device 45*a* for the boom 8 and a secondary port side of the solenoid proportional valve 54*a*, and which selects a high compression side of a pilot pressure within the pilot line 144*a* and a control pressure (second control signal) output from the solenoid proportional valve 54*a*, and introduces the high compression side to the hydraulic driving sections 150*a* and 151*a* of the flow control valves 15*a* and 15*b*; and a solenoid proportional valve 54*b* that is installed on the pilot line 144*b* of the operation device 45*a* for the boom 8, and which reduces a pilot pressure (first control signal) within the pilot line 144*b* on the basis of a control signal from a controller 40, and introduces the pilot pressure into the hydraulic driving sections 150*b* and 151*b* of the flow control valves 15*a* and 15*b*.

The front implement control hydraulic unit 160 includes: pressure sensors 71*a* and 71*b* as operator operation sensors that are installed on the pilot lines 145*a* and 145*b* for the arm 9, and which detect a pilot pressure (first control signal) as an operation amount of the operation lever 1*b*, and output the pilot pressure to the controller 40; a solenoid proportional valve 55*b* that is installed on the pilot line 145*b*, and which reduces a pilot pressure (first control signal) on the basis of a control signal from the controller 40, and introduces the pilot pressure into the hydraulic driving sections 152*b* and 153*b* of the flow control valves 15*c* and 15*d*; and a solenoid proportional valve 55*a* that is installed on the pilot line 145*a*, and which reduces a pilot pressure (first control signal) within the pilot line 145*a* on the basis of a control signal from the controller 40, and introduces the pilot pressure into the hydraulic driving sections 152*a* and 153*a* of the flow control valves 15*c* and 15*d*.

In addition, the front implement control hydraulic unit 160 includes: pressure sensors 72*a* and 72*b* as operator operation sensors that are installed on the pilot lines 146*a* and 146*b* for the bucket 10, and which detect a pilot pressure (first control signal) as an operation amount of the operation lever 1*a*, and output the pilot pressure to the controller 40; solenoid proportional valves 56*a* and 56*b* that reduce a pilot pressure (first control signal) on the basis of a control signal from the controller 40, and output the pilot pressure; solenoid proportional valves 56*c* and 56*d* that have a primary port side connected to the pilot pump 48, and which reduce and output the pilot pressure from the pilot pump 48; and shuttle valves 83*a* and 83*b* that select high compression sides of the pilot pressures within the pilot lines 146*a* and 146*b* and control pressures output from the solenoid proportional valves 56*c* and 56*d*, and introduce the high compression sides into the hydraulic driving sections 154*a* and 154*b* of the flow control valve 15*e*.

Incidentally, for simplicity of illustration in FIG. 3, only one flow control valve is illustrated in cases where a plurality of flow control valves are connected to a same pilot line, and as for the other flow control valves, reference characters of the flow control valves are indicated in parentheses. In addition, in FIG. 3, connection lines between the pressure sensors 70, 71, and 72 and the controller 40 are omitted due to space limitations.

Opening degrees of the solenoid proportional valves 54*b*, 55*a*, 55*b*, 56*a*, and 56*b* are at a maximum during non-energization, and are decreased as currents as control signals from the controller 40 are increased. On the other hand, opening degrees of the solenoid proportional valves 54*a*, 56*c*, and 56*d* are zero during non-energization, and are increased during energization as currents as control signals from the controller 40 are increased. That is, the opening degrees of the respective solenoid proportional valves 54, 55, and 56 correspond to the control signals from the controller 40.

In the present embodiment, of the control signals to the flow control valves 15*a* to 15*e*, the pilot pressures generated by operation of the operation devices 45*a*, 45*b*, and 46*a* will hereinafter be referred to as "first control signals." In addition, of the control signals to the flow control valves 15*a* to 15*e*, the pilot pressures generated by correcting (reducing) the first control signals when the controller 40 drives the solenoid proportional valves 54*b*, 55*a*, 55*b*, 56*a*, and 56*b* and the pilot pressures newly generated separately from the first control signals when the controller 40 drives the solenoid proportional valves 54*a*, 56*c*, and 56*d* will be referred to as "second control signals."

<Controller 40>

Figure 4:
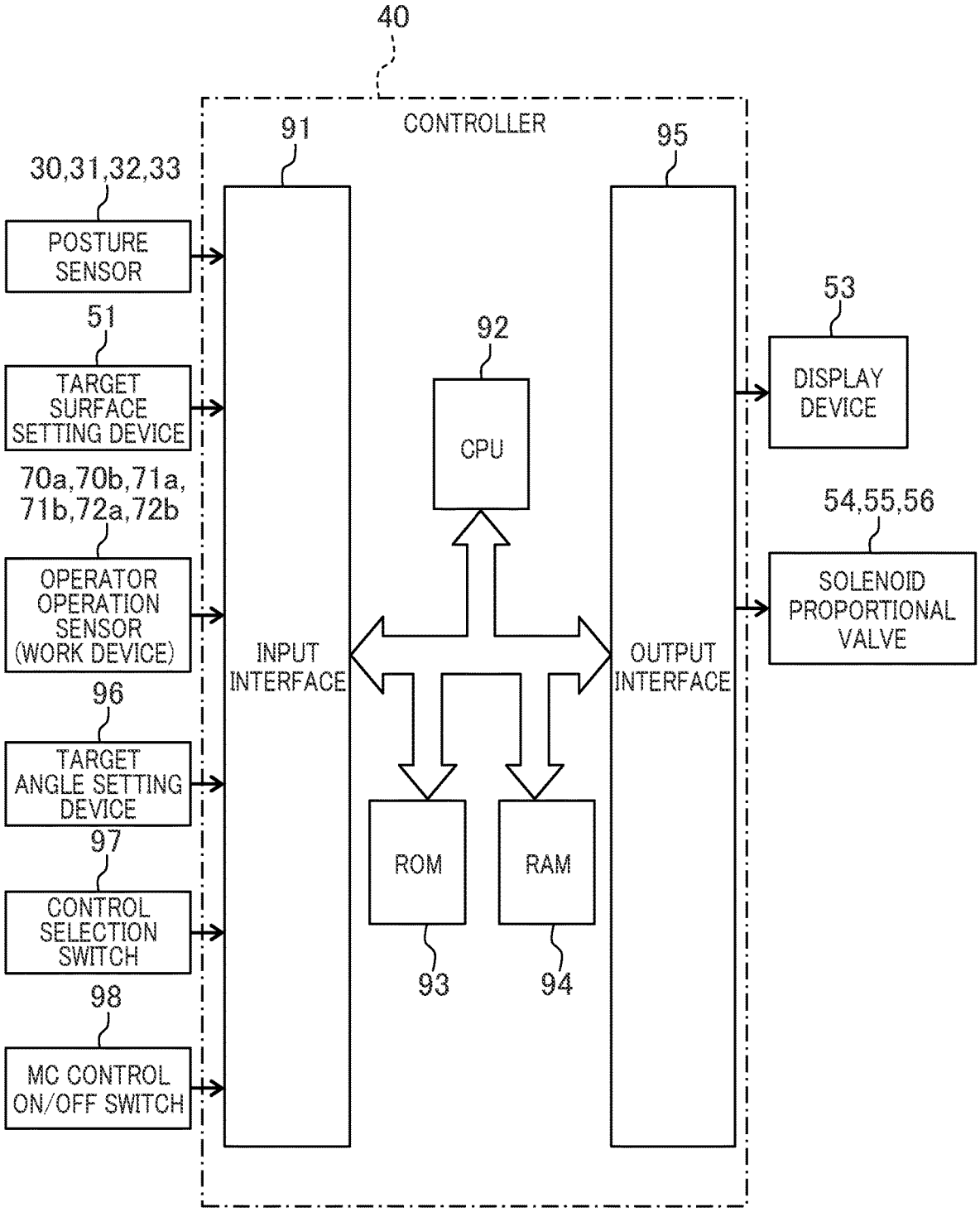
FIG. 4 is a diagram of a hardware configuration of the controller.

FIG. 4 is a diagram of a hardware configuration of the controller.

In FIG. 4, the controller 40 includes an input interface 91, a central processing unit (CPU) 92 as a processor, a read-only memory (ROM) 93 and a random access memory (RAM) 94 as a storage device, and an output interface 95. The input interface 91 is supplied with signals from the posture sensors (the boom angle sensor 30, the arm angle sensor 31, the bucket angle sensor 32, and the machine body inclination angle sensor 33), a signal from the target surface setting device 51, signals from the operator operation sensors (pressure sensors 70*a*, 70*b*, 71*a*, 71*b*, 72*a*, and 72*b*) and the control selection switch 97, a signal from the target angle setting device 96 which signal indicates a target angle, a signal from the control selection switch 97 which signal indicates a selection state in which the bucket angle control is enabled or disabled, and a signal from the MC control ON/OFF switch 98 which signal indicates a selection state in which the MC is enabled or disabled (ON/OFF). The input interface 91 performs A/D conversion on the signals. The ROM 93 is a recording medium storing a control program for executing a flowchart to be described later, various kinds of information necessary for executing the flowchart, and the like. The CPU 92 performs predetermined calculation processing on signals taken in from the input interface 91 and the memories 93 and 94 according to the control program stored in the ROM 93. The output interface 95 generates signals for output according to a result of calculation in the CPU 92, and outputs the signals to the display device 53 and the solenoid proportional valves 54, 55, and 56. Thus, the output interface 95 drives and controls the hydraulic actuators 5, 6, and 7, and causes an image of the main body 1B of the hydraulic excavator 1, the bucket 10, the target surface 60, and the like to be displayed on the display screen of the display device 53. Incidentally, while a case has been illustrated in which the controller 40 in FIG. 4 includes semiconductor memories of the ROM 93 and RAM 94 as a storage device, the semiconductor memories can be replaced with devices having a storage function. For example, the controller 40 may be of a configuration including a magnetic storage device such as a hard disk drive.

The controller 40 in the present embodiment performs, as machine control (MC), processing of controlling the work device 1A on the basis of a predetermined condition when the operation devices 45 and 46 are operated by the operator. The MC in the present embodiment may be referred to as "semiautomatic control" in which operation of the work device 1A is controlled by a computer only during operation of the operation devices 45*a*, 45*b*, 46*a*, and 46*b*, in contrast to "automatic control" in which operation of the work device 1A is controlled by a computer during non-operation of the operation devices 45*a*, 45*b*, 46*a*, and 46*b*.

As the MC of the work device 1A, what is generally called region limiting control is performed in which, when an excavation operation (specifically, an instruction for at least one of arm crowding, bucket crowding, and bucket dumping) is input via the operation devices 45*b* and 46*a*, a control signal to forcibly cause at least one of the hydraulic actuators 5, 6, and 7 to operate (for example, to perform boom raising operation forcibly by extending the boom cylinder 5) such that a position of a distal end of the work device 1A (which distal end is assumed to be the claw tip of the bucket 10 in the present embodiment) is retained in a region on and above the target surface 60 on the basis of a positional relation between the target surface 60 and the distal end of the work device 1A is output to a corresponding flow control valve 15*a* to 15*e*.

Such MC prevents the claw tip of the bucket 10 from entering below the target surface 60. Thus, excavation along the target surface 60 is made possible irrespective of a level of skills of the operator. Incidentally, while a control point of the work device 1A during the MC is set to the claw tip of the bucket 10 of the hydraulic excavator (distal end of the work device 1A) in the present embodiment, the control point can be changed to other than the bucket claw tip as long as the control point is a point of a distal end part of the work device 1A. That is, the control point may be set to a bottom surface of the bucket 10 or an outermost portion of the bucket link 13, for example.

In the front implement control hydraulic unit 160, when the solenoid proportional valves 54*a*, 56*c*, and 56*d* are driven by outputting control signals from the controller 40, pilot pressures (second control signals) can be generated even when there is no operation of the corresponding operation devices 45*a* and 46*a* by the operator. Thus, boom raising operation, bucket crowding operation, and bucket dumping operation can be produced forcibly. In addition, when the solenoid proportional valves 54*b*, 55*a*, 55*b*, 56*a*, and 56*b* are driven similarly by the controller 40, pilot pressures (second control signals) obtained by reducing pilot pressures (first control signals) generated by operator operations of the operation devices 45*a*, 45*b*, and 46*a* can be generated, and thus velocities of boom lowering operation, arm crowding/dumping operation, and bucket crowding/dumping operation can be forcibly reduced from the values of the operator operations.

A second control signal is generated when a velocity vector of the control point of the work device 1A which velocity vector is generated by a first control signal contradicts a predetermined condition. The second control signal is generated as a control signal that generates the velocity vector of the control point of the work device 1A which velocity vector does not contradict the predetermined condition. Incidentally, suppose that, when the first control signal is generated for one hydraulic driving section in a same flow control valve 15*a* to 15*e*, and the second control signal is generated for another hydraulic driving section, the second control signal is made to act on the hydraulic driving section preferentially. Thus, the first control signal is interrupted by the solenoid proportional valve, and the second control signal is input to the other hydraulic driving section. Hence, of the flow control valves 15*a* to 15*e*, a flow control valve for which the second control signal is calculated is controlled on the basis of the second control signal, a flow control valve for which the second control signal is not calculated is controlled on the basis of the first control signal, and a flow control valve for which neither of the first and second control signals is generated is not controlled (driven). That is, the MC in the present embodiment can be said to be control of the flow control valves 15*a* to 15*e* on the basis of the second control signals.

Figure 5:
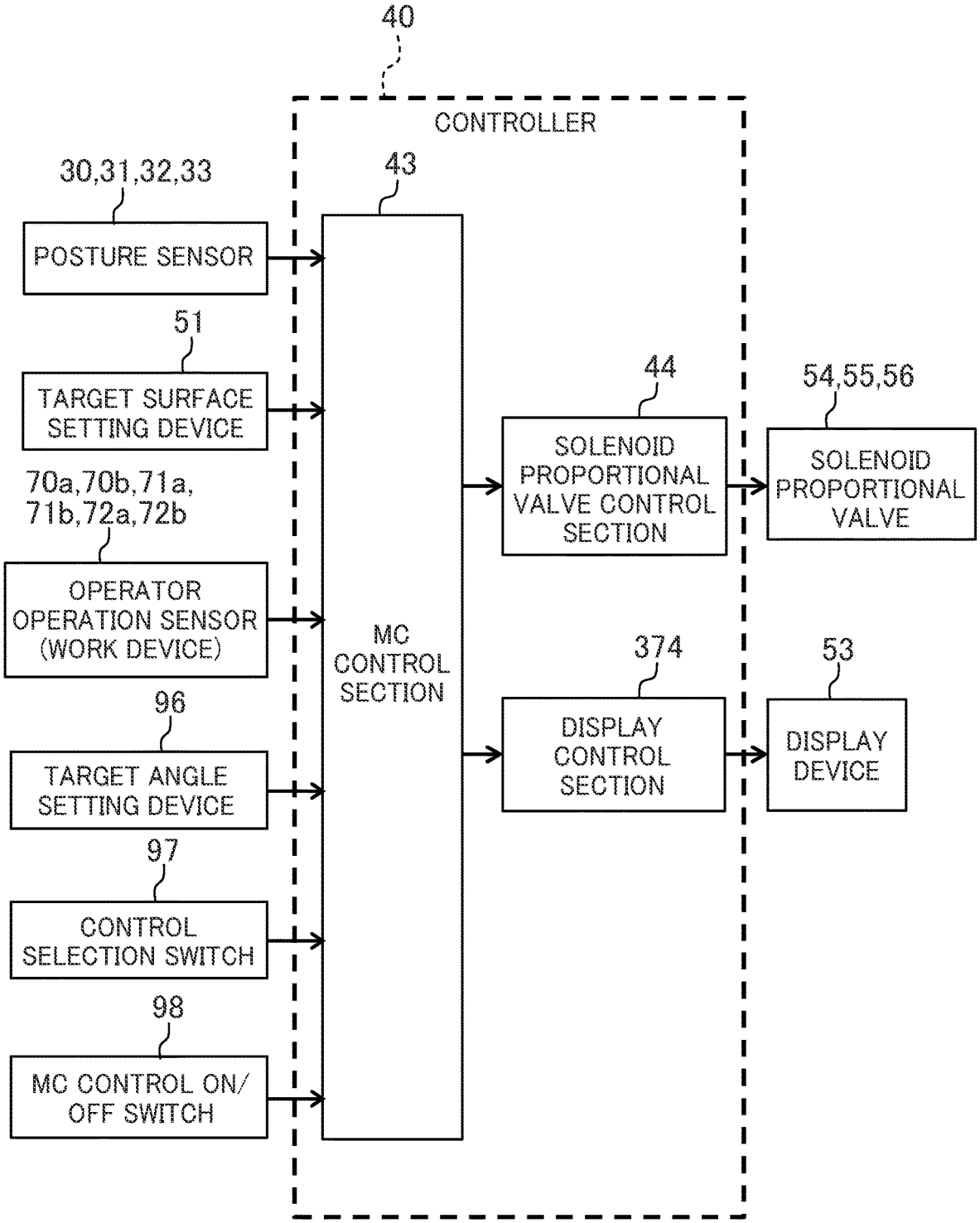
FIG. 5 is a functional block diagram illustrating processing functions of the controller.

FIG. 5 is a functional block diagram illustrating processing functions of the controller. In addition, FIG. 6 is a functional block diagram illustrating processing functions of an MC control section in FIG. 5 in detail together with a related configuration.

As illustrated in FIG. 5, the controller 40 includes an MC control section 43, a solenoid proportional valve control section 44, and a display control section 374.

The display control section 374 is a functional section that controls the display device 53 on the basis of a work device posture and a target surface output from the MC control section 43. The display control section 374 includes a display ROM that stores a large number of pieces of display related data including an image and an icon of the work device 1A. The display control section 374 reads a predetermined program on the basis of a flag included in input information, and performs display control in the display device 53.

Figure 6:
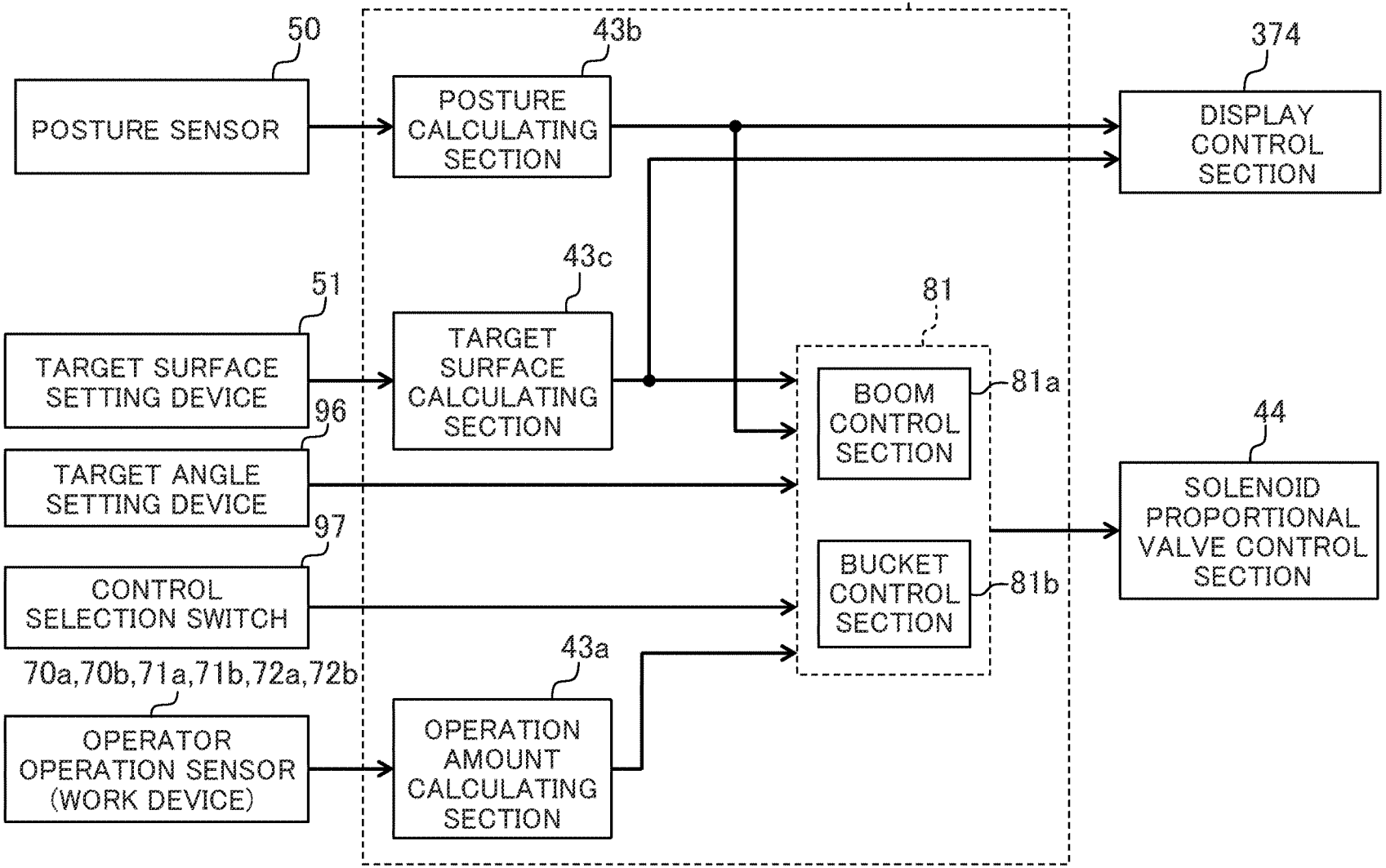
FIG. 6 is a functional block diagram illustrating details of processing functions of an MC control section in FIG. 5.

As illustrated in FIG. 6, the MC control section 43 includes an operation amount calculating section 43*a*, a posture calculating section 43*b*, a target surface calculating section 43*c*, and an actuator control section 81. In addition, the actuator control section 81 includes a boom control section 81*a* and a bucket control section 81*b*.

The operation amount calculating section 43*a* computes operation amounts of the operation devices 45*a*, 45*b*, and 46*a* (operation levers 1*a* and 1*b*) on the basis of inputs from the operator operation sensors (pressure sensors 70, 71, and 72). The operation amount calculating section 43*a* computes the operation amounts of the operation devices 45*a*, 45*b*, and 46*a* from detected values of the pressure sensors 70, 71, and 72. It is to be noted that the computation of the operation amounts by using the pressure sensors 70, 71, and 72 described in the present embodiment is a mere example. For example, the operation amounts of the operation devices 45*a*, 45*b*, and 46*a* may be detected by position sensors (for example, rotary encoders) that detect operation device rotational displacements of the respective operation devices.

The posture calculating section 43*b* calculates the posture of the work device 1A and the position of the claw tip of the bucket 10 in the local coordinate system on the basis of information from the posture sensors (the boom angle sensor 30, the arm angle sensor 31, the bucket angle sensor 32, and the machine body inclination angle sensor 33).

The target surface calculating section 43*c* calculates positional information of the target surface 60 on the basis of information from the target surface setting device 51, and stores this positional information in the ROM 93. In the present embodiment, as illustrated in FIG. 8, a sectional shape obtained by cutting a three-dimensional target surface by a plane in which the work device 1A moves (operation plane of the work device 1A) is used as the target surface 60 (two-dimensional target surface).

Incidentally, while FIG. 8 illustrates a case where there is one target surface 60, there may be a plurality of target surfaces. For cases where there are a plurality of target surfaces, there is, for example, a method of setting one closest to the work device 1A as a target surface, a method of setting one located below the bucket claw tip as a target surface, a method of setting one selected in a desired manner as a target surface, or the like.

The boom control section 81*a* and the bucket control section 81*b* constitute the actuator control section 81 that controls at least one of the plurality of hydraulic actuators 5, 6, and 7 according to a condition determined in advance at a time of operation of the operation devices 45*a*, 45*b*, and 46*a*. The actuator control section 81 calculates target pilot pressures of the flow control valves 15*a* to 15*e* of the respective hydraulic cylinders 5, 6, and 7, and outputs the calculated target pilot pressures to the solenoid proportional valve control section 44.

The boom control section 81*a* is a functional section for performing the MC that controls operation of the boom cylinder 5 (boom 8) such that the claw tip (control point) of the bucket 10 is located on the target surface 60 or above the target surface 60 on the basis of the position of the target surface 60, the posture of the work device 1A and the position of the claw tip of the bucket 10, and operation amounts of the operation devices 45*a*, 45*b*, and 46*a* at a time of operation of the operation devices 45*a*, 45*b*, and 46*a*. The boom control section 81*a* calculates target pilot pressures of the flow control valves 15*a* and 15*b* of the boom cylinder 5.

The bucket control section 81*b* is a functional section for performing the bucket angle control by the MC at a time of operation of the operation devices 45*a*, 45*b*, and 46*a*. Specifically, when a distance between the target surface 60 and the claw tip of the bucket 10 is equal to or less than a predetermined value, the MC (bucket angle control) is performed which controls operation of the bucket cylinder 7 (that is, the bucket 10) such that the angle of the bucket 10 with respect to the target surface 60 (which angle can be computed from the angles θ and φ) becomes a bucket angle with respect to the target surface which bucket angle is set in advance by the target angle setting device 96. The bucket control section 81*b* calculates a target pilot pressure of the flow control valve 15*e* of the bucket cylinder 7.

The solenoid proportional valve control section 44 calculates a command to each of the solenoid proportional valves 54 to 56 on the basis of the target pilot pressures for the respective flow control valves 15*a* to 15*e* which target pilot pressures are output from the actuator control section 81 of the MC control section 43. Incidentally, when a pilot pressure (first control signal) based on an operator operation and a target pilot pressure computed by the actuator control section 81 coincide with each other, a current value (command value) for the corresponding solenoid proportional valve 54 to 56 is zero, and operation of the corresponding solenoid proportional valve 54 to 56 is not performed.

<Boom Control (Boom Control Section 81*a*) according to MC>

Details of boom control according to the MC will be described in the following.

Figure 7:
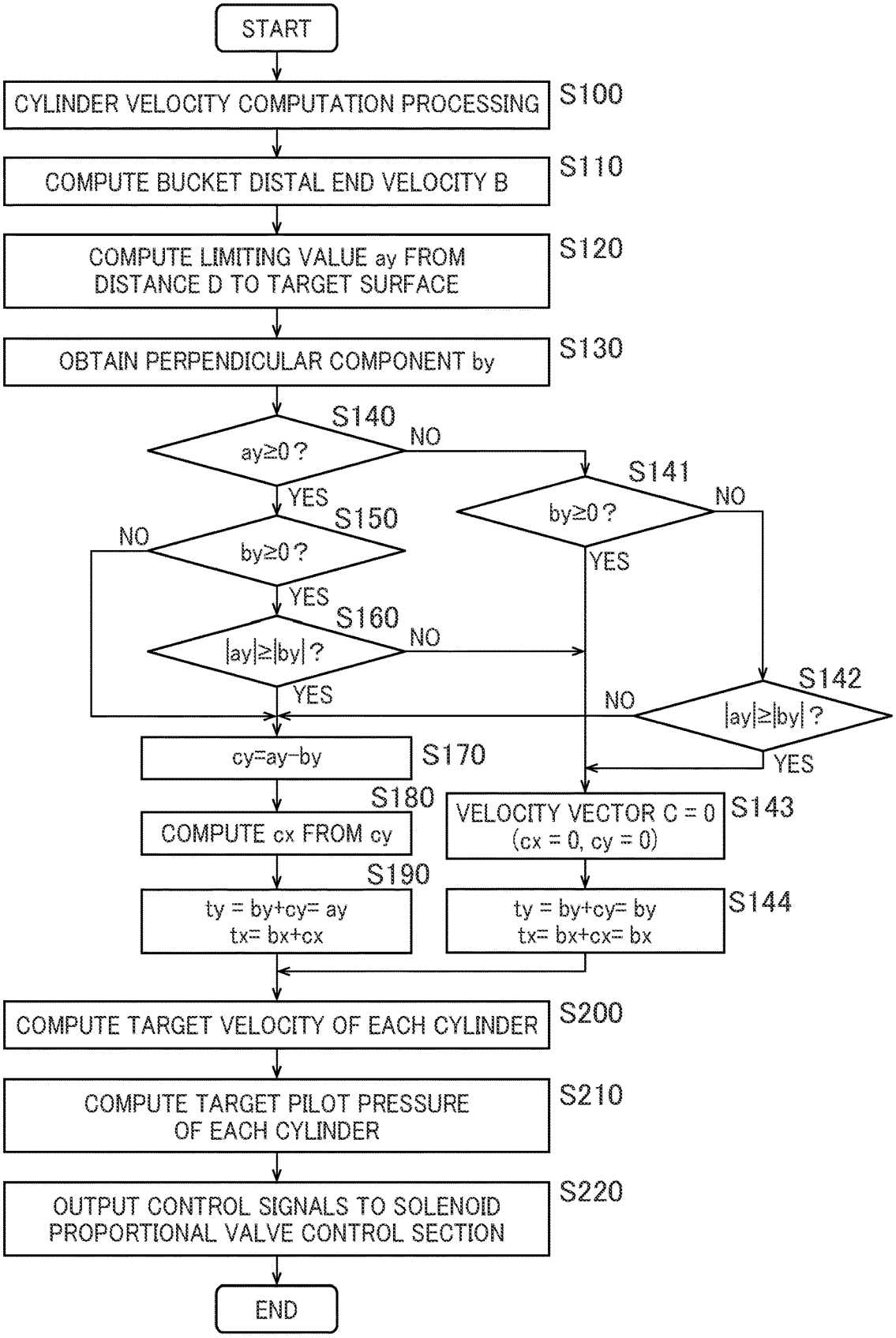
FIG. 7 is a flowchart illustrating processing contents of MC by the controller for a boom.
Figure 9:
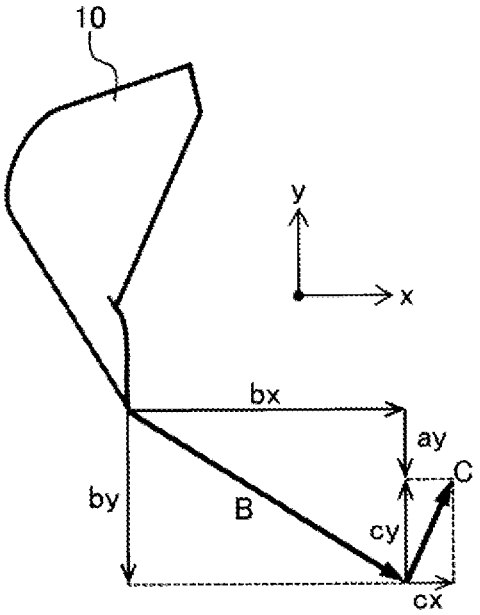
FIG. 9 is a diagram illustrating an example of velocity components of a bucket.
Figure 10:
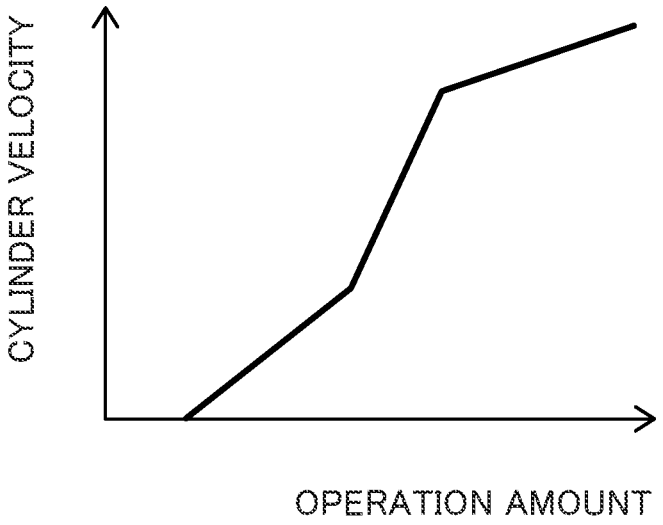
FIG. 10 is a diagram illustrating an example of a setting table of a cylinder velocity with respect to an operation amount.
Figure 11:
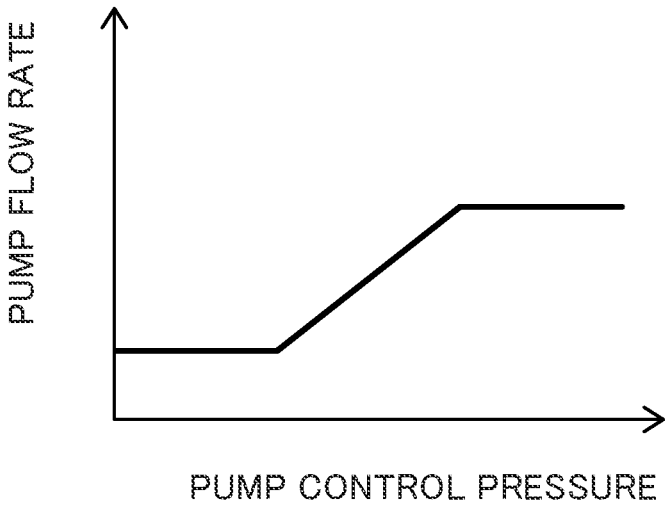
FIG. 11 is a diagram illustrating a relation between a pump control pressure and a pump flow rate.

FIG. 7 is a flowchart illustrating processing contents of the MC by the controller for the boom. In addition, FIG. 9 is a diagram illustrating an example of velocity components of the bucket. FIG. 10 is a diagram illustrating an example of a setting table of cylinder velocity with respect to the operation amount of an operation device.

The controller 40 performs boom raising control by the boom control section 81*a* as the boom control in the MC. The processing of the boom control section 81*a* is started when the operation devices 45*a*, 45*b*, and 46*a* are operated by the operator.

In FIG. 7, when the operation devices 45*a*, 45*b*, and 46*a* are operated by the operator, the boom control section 81*a* first performs cylinder velocity computation processing that calculates operation velocities (cylinder velocities) of the respective hydraulic cylinders 5, 6, and 7 on the basis of operation amounts calculated by the operation amount calculating section 43*a* (step S100). Specifically, as illustrated in FIG. 10, for example, the cylinder velocities of the boom cylinder 5, the arm cylinder 6, the bucket cylinder 7, and the like with respect to the operation amounts of the operation levers of the boom 8, the arm 9, the bucket 10, and the like, the cylinder velocities being obtained by experiment or simulation in advance, are set as a table, and the cylinder velocities of the respective hydraulic cylinders 5, 6, and 7 are computed according to this table. In addition, the velocity of the arm cylinder 6 is corrected by using a correction gain k in arm cylinder velocity correction processing to be described later.

Next, the boom control section 81*a* calculates a velocity vector B of a distal end (claw tip) of the bucket due to an operator operation on the basis of the operation velocities of the respective hydraulic cylinders 5, 6, and 7 calculated in step S100 and the posture of the work device 1A calculated by the posture calculating section 43*b* (step S110).

Next, the boom control section 81*a* computes a limiting value ay of a component of the velocity vector of the distal end of the bucket which component is perpendicular to the target surface 60 by using a distance D of the claw tip of the bucket 10 from the target surface 60 on the basis of a predetermined relation between the distance D and the limiting value ay (step S120).

Next, the boom control section 81*a* obtains a component by of the velocity vector B of the distal end of the bucket due to the operator operation which component is perpendicular to the target surface 60, the velocity vector B being computed in step S120 (step S130).

Figure 12:
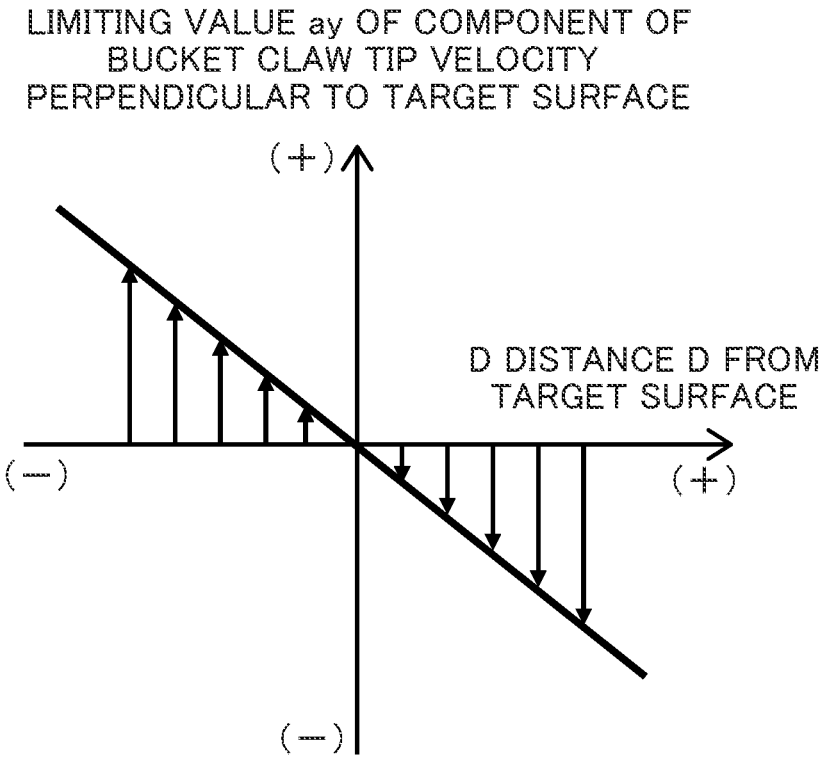
FIG. 12 is a diagram illustrating a relation between a limiting value of a perpendicular component of a bucket claw tip velocity and a distance.

Next, the boom control section 81*a* determines whether or not the limiting value ay computed in step S130 is equal to or more than zero (step S140). Incidentally, as illustrated in FIG. 9, xy coordinates are set for the bucket 10. In the xy coordinates of FIG. 9, an X-axis is parallel with the target surface 60 and has a right direction in the figure as a positive direction thereof, and a Y-axis is perpendicular to the target surface 60 and has an upward direction in the figure as a positive direction thereof. In FIG. 9, the perpendicular component by and the limiting value ay are negative, and a horizontal component bx, a horizontal component cx, and a perpendicular component cy are positive. Then, as is clear from FIG. 12, when the limiting value ay is zero, the distance D is zero, that is, the claw tip is positioned on the target surface 60; when the limiting value ay is positive, the distance D is negative, that is, the claw tip is positioned below the target surface 60; and when the limiting value ay is negative, the distance D is positive, that is, the claw tip is positioned above the target surface 60.

When a result of the determination in step S140 is YES, that is, when the boom control section 81*a* determines that the limiting value ay is equal to or more than zero and thus the claw tip is positioned on or below the target surface 60, the boom control section 81*a* determines whether or not the perpendicular component by of the velocity vector B of the claw tip due to the operator operation is equal to or more than zero (step S150). A positive perpendicular component by indicates that the perpendicular component by of the velocity vector B is upward. A negative perpendicular component by indicates that the perpendicular component by of the velocity vector B is downward.

When a result of the determination in step S150 is YES, that is, when the boom control section 81*a* determines that the perpendicular component by is equal to or more than zero and thus the perpendicular component by is upward, the boom control section 81*a* determines whether or not an absolute value of the limiting value ay is equal to or more than an absolute value of the perpendicular component by (step S160). When a result of the determination is YES, the boom control section 81*a* selects "cy=ay−by" as an equation for computing a component cy of a velocity vector C of the distal end of the bucket which velocity vector is to be generated by operation of the boom 8 by machine control, the component cy being perpendicular to the target surface 60, and computes the perpendicular component cy on the basis of the equation and the limiting value ay computed in step S140 and the perpendicular component by computed in step S150 (step S170).

Next, the boom control section 81*a* computes the velocity vector C such that the perpendicular component cy computed in step S170 can be output, and sets a horizontal component of the velocity vector C as cx (step S180).

Next, the boom control section 81*a* computes a target velocity vector T (step S190). The boom control section 81*a* then proceeds to step S200. The target velocity vector T can be expressed by "ty=by+cy, tx=bx+cx," where ty is a component perpendicular to the target surface 60, and tx is a component horizontal to the target surface 60. When cy=ay−by computed in step S170 is substituted into this, the target velocity vector T is "ty=ay, tx=bx+cx." That is, the perpendicular component ty of the target velocity vector when the processing of step S190 is reached is limited to the limiting value ay, and control of forced boom raising by the machine control is activated.

When the result of the determination in step S140 is NO, that is, when the limiting value ay is less than zero, the boom control section 81*a* determines whether or not the perpendicular component by of the velocity vector B of the claw tip due to the operator operation is equal to or more than zero (step S141). When a result of the determination in step S141 is YES, the processing proceeds to step S143. When the result of the determination in step S141 is NO, the processing proceeds to step S142.

When the result of the determination in step S141 is NO, that is, when the perpendicular component by is less than zero, the boom control section 81*a* determines whether or not the absolute value of the limiting value ay is equal to or more than the absolute value of the perpendicular component by (step S142). When a result of the determination is YES, the boom control section 81*a* proceeds to step S143. When the result of the determination is NO, the boom control section 81*a* proceeds to step S170.

When the result of the determination in step S141 is YES, that is, when the boom control section 81*a* determines that the perpendicular component by is equal to or more than zero (when the perpendicular component by is upward), or when the result of the determination in step S142 is YES, that is, when the absolute value of the limiting value ay is equal to or more than the absolute value of the perpendicular component by, the boom control section 81*a* determines that the boom 8 does not need to be operated by the machine control, and sets the velocity vector C to zero (step S143).

Next, the boom control section 81*a* sets the target velocity vector T as "ty=by, tx=bx" on the basis of an equation (ty=by+cy, tx=bx+cx) similar to that of step S190 (step S144). This coincides with the velocity vector B due to the operator operation.

When the processing of step S190 or step S144 is ended, the boom control section 81*a* next calculates target velocities of the respective hydraulic cylinders 5, 6, and 7 on the basis of the target velocity vector T (ty, tx) determined in step S190 or step S144 (step S200). Incidentally, as is clear from the above description, when the target velocity vector T does not coincide with the velocity vector B, the target velocity vector T is realized by adding the velocity vector C to be generated by operation of the boom 8 due to the machine control to the velocity vector B.

Next, the boom control section 81*a* calculates target pilot pressures for the flow control valves 15*a* to 15*e* of the respective hydraulic cylinders 5, 6, and 7 on the basis of the target velocities of the respective cylinders 5, 6, and 7 computed in step S200 (step S210).

Next, the boom control section 81*a* outputs the target pilot pressures for the flow control valves 15*a* to 15*e* of the respective hydraulic cylinders 5, 6, and 7 to the solenoid proportional valve control section 44 (step S220). The boom control section 81*a* then ends the processing.

As a result of thus performing the processing of the flowchart illustrated in FIG. 7, the solenoid proportional valve control section 44 controls the solenoid proportional valves 54, 55, and 56 such that the target pilot pressures act on the flow control valves 15*a* to 15*e* of the respective hydraulic cylinders 5, 6, and 7, and excavation by the work device 1A is thereby performed. When the operator operates the operation device 45*b* to perform a horizontal excavation by arm crowding operation, for example, the solenoid proportional valve 55*c* is controlled such that the distal end of the bucket 10 does not enter the target surface 60, and thus an operation of raising the boom 8 is performed automatically.

<Arm Cylinder Velocity Correction Processing>

The arm cylinder velocity correction processing indicated in step S100 in FIG. 7 will next be described.

Figure 13:
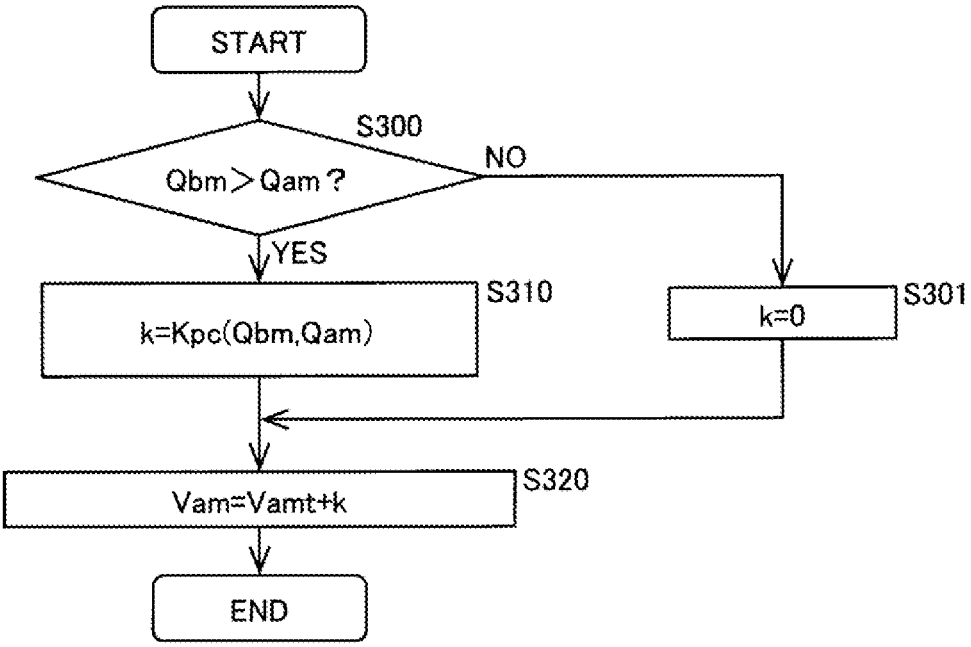
FIG. 13 is a flowchart illustrating processing contents of arm cylinder velocity correction processing.

FIG. 13 is a flowchart illustrating processing contents of the arm cylinder velocity correction processing.

In FIG. 13, first, whether an operation amount Qbm of the boom is larger than an operation amount Qam of the arm is determined (step S300). When a result of the determination in step S300 is YES, that is, when the operation amount Qbm of the boom is larger than the operation amount Qam of the arm, the correction gain k is computed according to a predetermined function k=Kpc (Qbm, Qam) (step S310). Incidentally, the function Kpc is a function correlated to a pump flow rate resulting from positive control based on the boom operation amount Qbm and a pump flow rate resulting from positive control based on the arm operation amount Qam.

In addition, the correction gain k is set equal to 0 (zero) when the result of the determination in step S300 is NO, that is, when the operation amount Qbm of the boom is equal to or smaller than the operation amount Qam of the arm.

After the correction gain k is computed in step S310 or step S301, a correction is next made such that Arm Velocity Vam=Vamt+k (step S320). The processing is then ended. Vam computed by the arm cylinder velocity correction processing is the arm cylinder velocity computed in step S100 in FIG. 7.

Actions and effects of the present embodiment configured as described above will be described.

Figure 14:
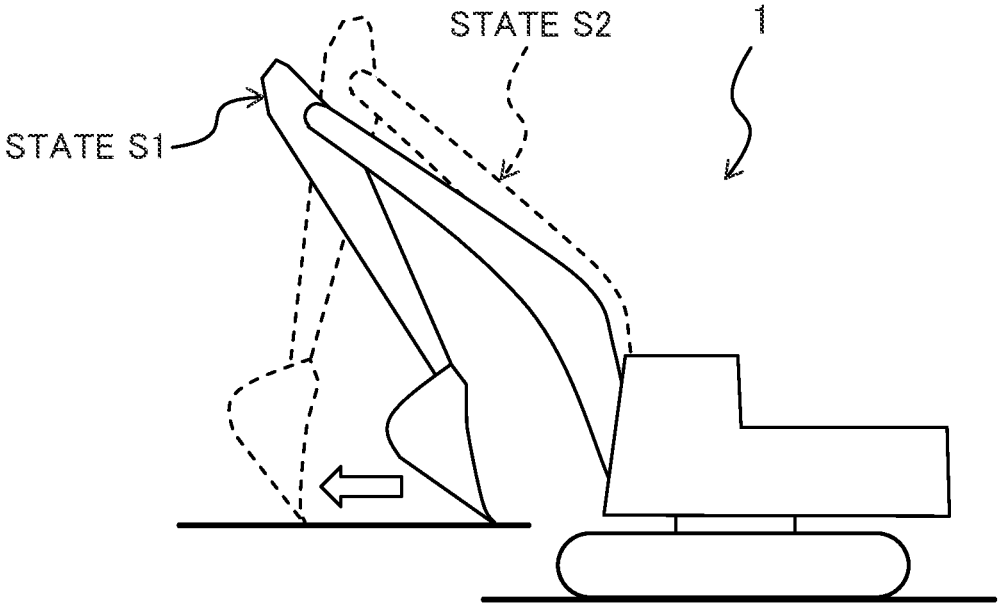
FIG. 14 is a diagram illustrating an example of a change in a work state of the hydraulic excavator.

FIG. 14 is a diagram illustrating an example of a change in a work state of the hydraulic excavator.

Referring to FIG. 14, description will be made of operation of the operator and the MC by the controller 40 (boom control section 81*a*) when a transition is made from a state S1 (Boom Operation Amount>Arm Operation Amount) to a state S2 (Boom Operation Amount≤Arm Operation Amount).

While the transition is made from the state S1 to the state S2 in FIG. 14, the operator performs a dumping operation of the arm 9. When it is determined that the dumping operation of the arm 9 causes the bucket 10 to enter the target surface 60, control (MC) that raises the boom 8 is performed by issuing a command from the boom control section 81*a* to the solenoid proportional valve 54*a*.

In addition, when the MC is performed in a state in which the operation amount of the boom is larger than the operation amount of the arm as in the state S1, the arm cylinder velocity correction processing (see FIG. 13) can suppress the arm cylinder velocity from becoming higher than assumed because an actual pump flow rate is increased more than at a time of single arm operation by computing an estimated value of the arm cylinder velocity higher than assumed. Thus, a boom raising operation amount can be computed more accurately.

In addition, when the MC is performed in a state in which the operation amount of the boom is smaller than the operation amount of the arm as in the state S2, the actual pump flow rate coincides with that at the time of single arm operation, there is substantially no effect of the pump flow rate on the arm cylinder velocity, and the boom raising operation amount can be computed more accurately on the basis of the arm cylinder velocity correction processing (see FIG. 13).

That is, in the present embodiment configured as described above, an appropriate correction amount is added to an assumed arm velocity in consideration of a pump flow rate resulting from positive control based on the boom operation amount and a pump flow rate based on the arm operation amount. Thus, a deviation from an actual arm cylinder velocity is decreased, an appropriate boom raising operation amount can be computed, and thus the MC can be stabilized.

Incidentally, while the angle sensors that detect the angles of the boom 8, the arm 9, and the bucket 10 are used in the present embodiment, a configuration may be adopted in which the posture information of the excavator is computed by cylinder stroke sensors rather than the angle sensors. In addition, while a hydraulic pilot type hydraulic excavator has been illustrated and described, application to an electric lever type hydraulic excavator is also possible. For example, a configuration may be adopted such that a command current generated from an electric lever is controlled. In addition, the velocity vector of the work device 1A may be obtained from angular velocities computed by differentiating the angles of the boom 8, the arm 9, and the bucket 10, rather than the pilot pressures due to the operator operation.

Features of the foregoing embodiment will next be described.

(1) In the foregoing embodiment, the work machine includes: the articulated work device 1A formed by a plurality of driven members including the boom 8 having a proximal end rotatably coupled to the upper swing structure 12, the arm 9 having one end rotatably coupled to the distal end of the boom, and a work tool (for example, the bucket 10) rotatably coupled to another end of the arm; a plurality of hydraulic actuators including the boom cylinder 5 that drives the boom on the basis of an operation signal, the arm cylinder 6 that drives the arm on the basis of an operation signal, and a work tool cylinder (for example, the bucket cylinder 7) that drives the work tool on the basis of an operation signal; the plurality of hydraulic pumps 2*a* and 2*b* that deliver hydraulic fluid for driving the plurality of hydraulic actuators; the operation devices 45*a*, 45*b*, 46*a*, and 46*b* that output an operation signal for operating a hydraulic actuator desired by an operator among the plurality of hydraulic actuators; the plurality of flow control valves 15*a* to 15*e* that are arranged so as to respectively correspond to the plurality of hydraulic actuators, and that control directions and flow rates of the hydraulic fluid supplied from the hydraulic pumps to the plurality of hydraulic actuators on the basis of the operation signals from the operation devices; and the controller 40 configured to output a control signal that controls the flow control valve corresponding to at least one of the plurality of hydraulic actuators such that the work device operates within a region on and above the target surface set for a work target of the work device, or perform the region limiting control that corrects the control signal output to control the flow control valve corresponding to at least one of the plurality of hydraulic actuators from the operation devices. In the work machine, the controller is configured to compute an estimated velocity of the arm cylinder used for the region limiting control on the basis of a first condition defining, in advance, a relation between an operation amount of the operation device and the estimated velocity of the arm cylinder when an operation amount of the operation device corresponding to the boom cylinder is equal to or smaller than the operation amount of the operation device corresponding to the arm cylinder, and the controller is configured to compute the estimated velocity of the arm cylinder used for the region limiting control as a velocity higher than the estimated velocity of the arm cylinder computed on the basis of the first condition when the operation amount of the operation device corresponding to the boom cylinder is larger than the operation amount of the operation device corresponding to the arm cylinder.

The behavior of the work device can thereby be stabilized.

(2) In addition, in the foregoing embodiment, in the work machine of (1) (for example, the hydraulic excavator 1), the estimated velocity of the arm cylinder computed when the operation amount of the operation device corresponding to the boom cylinder 5 is larger than the operation amount of the operation device 45*a* corresponding to the arm cylinder 6 is computed on the basis of a delivery flow rate of a hydraulic pump subjected to positive control based on operation of the operation device 45*b* corresponding to the boom cylinder and a delivery flow rate of a hydraulic pump subjected to positive control based on operation of the operation device corresponding to the arm cylinder.

<Supplementary Notes>

It is to be noted that the present invention is not limited to the foregoing embodiment, but includes various modifications and combinations within a scope not departing from the spirit of the present invention. In addition, the present invention is not limited to those including all of the configurations described in the foregoing embodiment, but also includes those from which a part of the configurations are omitted. In addition, a part or the whole of each of the configurations, the functions, and the like described above may be implemented by, for example, being designed in an integrated circuit or the like. In addition, each of the configurations, the functions, and the like described above may be implemented by software such that a processor interprets and executes a program that implements each function.

DESCRIPTION OF REFERENCE CHARACTERS

1 . . . Hydraulic excavator, 1*a*, 1*b* . . . Operation lever, 1A . . . Work device, 1B . . . Main body, 2 . . . Hydraulic pump, 2*aa*, 2*ba* . . . Regulator, 3*a*, 3*b* . . . Travelling hydraulic motor, 4 . . . Swing hydraulic motor, 5 . . . Boom cylinder, 6 . . . Arm cylinder, 7 . . . Bucket cylinder, 8 . . . Boom, 9 . . . Arm, 10 . . . Bucket, 11 . . . Undercarriage, 12 . . . Upper swing structure, 13 . . . Bucket link, 15*a* to 15*h* . . . Flow control valve, 18 . . . Engine, 23*a*, 23*b* . . . Travelling operation lever, 30 . . . Boom angle sensor, 31 . . . Arm angle sensor, 32 . . . Bucket angle sensor, 33 . . . Machine body inclination angle sensor, 39 . . . Lock valve, 40 . . . Controller, 43 . . . MC control section, 43*a* . . . Operation amount calculating section, 43*b* . . . Posture calculating section, 43*c* . . . Target surface calculating section, 44 . . . Solenoid proportional valve control section, 45 to 47 . . . Operation device, 48 . . . Pilot pump, 50 . . . Posture sensor, 51 . . . Target surface setting device, 53 . . . Display device, 54 to 56 . . . Solenoid proportional valve, 60 . . . Target surface, 70 to 72 . . . Pressure sensor, 81 . . . Actuator control section, 81*a* . . . Boom control section, 81*b* . . . Bucket control section, 81*c* . . . Bucket control determining section, 82*a*, 83*a*, 83*b* . . . Shuttle valve, 91 . . . Input interface, 92 . . . Central processing device (CPU), 93 . . . Read-only memory (ROM), 94 . . . Random access memory (RAM), 95 . . . Output interface, 96 . . . Target angle setting device, 97 . . . Control selection switch, 144 to 149 . . . Pilot line, 150*a* to 157*a*, 150*b* to 157*b* . . . Hydraulic driving section, 160 . . . Front implement control hydraulic unit, 162 . . . Shuttle block, 200 . . . Hydraulic operating fluid tank, 374 . . . Display control section

The invention claimed is:

1. A work machine comprising:

an articulated work device formed by a plurality of driven members including a boom having a proximal end rotatably coupled to an upper swing structure, an arm having one end rotatably coupled to a distal end of the boom, and a work tool rotatably coupled to another end of the arm;

a plurality of hydraulic actuators including a boom cylinder that drives the boom on a basis of an operation signal, an arm cylinder that drives the arm on a basis of an operation signal, and a work tool cylinder that drives the work tool on a basis of an operation signal;

a plurality of hydraulic pumps that deliver hydraulic fluid for driving the plurality of hydraulic actuators;

operation devices that output an operation signal for operating a hydraulic actuator desired by an operator among the plurality of hydraulic actuators;

a plurality of flow control valves that are arranged so as to respectively correspond to the plurality of hydraulic actuators, and that control directions and flow rates of the hydraulic fluid supplied from the hydraulic pumps to the plurality of hydraulic actuators on a basis of the operation signals from the operation devices; and a controller configured to output a control signal that controls the flow control valve corresponding to at least one of the plurality of hydraulic actuators such that the work device operates within a region on and above a target surface set for a work target of the work device, or perform region limiting control that corrects the control signal output to control the flow control valve corresponding to at least one of the plurality of hydraulic actuators from the operation devices, wherein the controller is configured to compute a first estimated velocity of the arm cylinder used for the region limiting control on a basis of a first condition defining, in advance, a relation between an operation amount of the operation device corresponding to the arm cylinder and the first estimated velocity of the arm cylinder when an operation amount of the operation device corresponding to the boom cylinder is equal to or smaller than the operation amount of the operation device corresponding to the arm cylinder, and the controller is configured to compute a second estimated velocity of the arm cylinder used for the region limiting control as a velocity higher than the first estimated velocity of the arm cylinder computed on the basis of the first condition when the operation amount of the operation device corresponding to the boom cylinder is larger than the operation amount of the operation device corresponding to the arm cylinder.

2. The work machine according to claim 1, wherein the second estimated velocity of the arm cylinder is computed when the operation amount of the operation device corresponding to the boom cylinder is larger than the operation amount of the operation device corresponding to the arm cylinder is computed on a basis of a delivery flow rate of a hydraulic pump subjected to positive control based on operation of the operation device corresponding to the boom cylinder and a delivery flow rate of a hydraulic pump subjected to positive control based on operation of the operation device corresponding to the arm cylinder.

* * * * *